US007406912B2

(12) United States Patent
Fukanuma et al.

(10) Patent No.: US 7,406,912 B2
(45) Date of Patent: Aug. 5, 2008

(54) SWASH PLATE COMPRESSOR

(75) Inventors: Tetsuhiko Fukanuma, Kariya (JP); Manabu Sugiura, Kariya (JP); Takahiro Sugioka, Kariya (JP); Takayuki Imai, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 278 days.

(21) Appl. No.: 11/396,180

(22) Filed: Mar. 31, 2006

(65) Prior Publication Data

US 2006/0245935 A1 Nov. 2, 2006

(30) Foreign Application Priority Data

Apr. 13, 2005 (JP) ..... 2005-115183

(51) Int. Cl.
*F01B 3/00* (2006.01)

(52) U.S. Cl. ..... 92/12.2; 92/71

(58) Field of Classification Search ..... 92/12.2, 92/71

See application file for complete search history.

(56) References Cited

U.S. PATENT DOCUMENTS

2001/0054352 A1 12/2001 Sugiura et al.
2003/0063980 A1 4/2003 Doll
2004/0020357 A1* 2/2004 Schwarzkopf ..... 92/71

FOREIGN PATENT DOCUMENTS

| | | |
|---|---|---|
| EP | 1167761 | 1/2002 |
| EP | 1172556 | 1/2002 |
| JP | 8-28447 | 1/1996 |
| JP | 2002-005013 | 1/2002 |

* cited by examiner

*Primary Examiner*—F. Daniel Lopez
(74) *Attorney, Agent, or Firm*—Knoble Yoshida & Dunleavy, LLC

(57) ABSTRACT

A swash plate compressor includes a housing that has a cylinder bore and rotatably supports a drive shaft. A swash plate is operatively coupled to the drive shaft for rotation therewith. A piston is accommodated in the cylinder bore for reciprocating movement. First and second spaced shoes are fitted to the piston on a side adjacent to the cylinder bore and on a side away from the cylinder bore, respectively, for coupling the piston to the swash plate. The rolling body is mounted on the swash plate through a bearing and in slide contact with the first shoe. A surface of the rolling body in slide contact with the first shoe or a surface of the first shoe in slide contact with the rolling body has a diamond-like carbon film. A surface of the rolling body in rolling contact with the bearing exposes a base material of the rolling body.

17 Claims, 8 Drawing Sheets

SWASH PLATE COMPRESSOR

BACKGROUND OF THE INVENTION

The present invention relates generally to a swash plate compressor and, more specifically, to a mechanism for converting the rotation of a swash plate into the reciprocating movement of pistons.

A conventional variable displacement swash plate compressor for compressing refrigerant gas is disclosed, for example, in unexamined Japanese patent application publication No. 8-28447. According to this publication, the compressor has a single-headed piston 22 which is slidably received in each cylinder bore 1*a* and a pair of spherical shoes 23A, 23B which is fitted in neck portion of the single-headed piston 22. The swash plate 15 has a boss portion formed at its rear face, and a thrust bearing 20 is fitted to the boss portion through the races 20*a*, 20*b* on the front and rear sides of the bearing 20, respectively. The race 20*a* is in contact with the swash plate 15. The swash plate 15 and the thrust bearing 20 are inserted between the shoes 23A, 23B, so that the shoes 23A, 23B are in contact with the swash plate 15 and the race 20*b*, respectively. The rotation of the swash plate 15 is converted into the reciprocating movement of the single-headed piston 22 through the shoes 23A, 23B and the thrust bearing 20.

In such swash plate compressor, the race 20*a* adjacent to the swash plate 15 rotates following the rotation of the swash plate 15, but the race 20*b* adjacent to the shoe 23B hardly follows the rotation of the swash plate 15 because of the rollers 20*c*. Therefore, the resistance due to the relative displacement between the swash plate 15 and the shoe 23B is provided only by the rolling resistance of the rollers 20*c*. This rolling resistance is far smaller than the slide resistance produced when the shoe 23B is provided in direct contact with the swash plate 15. This helps improve the compression efficiency by reducing power loss.

Another conventional compressor is disclosed in unexamined Japanese patent application publication No. 2002-5013. The compressor has a drive shaft 21 which is rotatably supported by the housing assembly H and a swash plate 22 which is supported on the drive shaft 21 and accommodated in crank chamber 16 of the compressor. The swash plate 22 has a land portion 23 at its radially inner portion and a peripheral portion 24 having a reduced thickness. This swash plate 22 is operatively connected to the drive shaft 21 through a hinge mechanism 25 and a lug plate 26, so that the swash plate 22 is rotatable with the drive shaft 21 and tiltable with respect to the drive shaft 21 while sliding in the axial direction of the drive shaft 21.

The peripheral portion 24 of the swash plate 22 is slidably held between the pair of shoes 27 and 28 so that the swash plate 22 is operatively connected to each single-headed piston 20. As the swash plate 22 rotates with the drive shaft 21, the rotation of the swash plate 22 is converted into reciprocating movement of each piston 20 for compression of refrigerant gas in a manner that is well known in the art. The swash plate 22 is coated with a film of amorphous hard carbon 43, 44, which is called diamond-like carbon film, at the front and rear surfaces 39, 40 of the entire peripheral portion 24 thereof. The provision of such film protects the slide surfaces between the swash plate 22 and the shoes 27, 28 from abrasion or seizure which may otherwise occur.

According to the swash plate compressor disclosed in the publication No. 8-28447, however, it is difficult for an oil film to be formed on the contact surface between the race 20*b* and the shoe 23B due to the less relative rotation therebetween in the rotational direction of the swash plate 15. Moreover, small vibration of the swash plate 15 occurring in vertical direction during the compression and suction strokes may cause abrasion or seizure between the race 20*b* and the shoe 23B despite the provision of the thrust bearing 20.

To solve the problem in the above publication No. 8-28447, it is conceivable that the disclosure of the above publication No. 2002-5013 is applied to the compressor of the publication No. 8-28447 by forming an amorphous hard carbon film having characteristics of low friction and high hardness over the whole surface of the race 20*b* thereby to improve the sliding condition between the race 20*b* and the shoe 23B. However, in the case of the swash plate compressor disclosed in the publication No. 8-28447, the race 20*b* is pressed against the rollers 20*c* by the compression reaction force and minute dents are formed partially on the surface of the race 20*b* adjacent to the rollers 20*c*. Resistance due to such dents on the race 20*b* and the rolling friction of the rollers 20*c* cause the amorphous hard carbon film on the surface adjacent to the rollers 20*c* to peel off. Peeled-off film pieces present in the compressor as a foreign substance may affect various sliding portions of the compressor.

The present invention is directed to providing a swash plate compressor wherein a rolling body assembled to a swash plate through a bearing is arranged in slide contact with a shoe fitted to the piston so as to prevent the abrasion of the contact surfaces between the rolling body and the shoe and also the abrasion of the contact surfaces between the rolling body and the bearing and further to prevent peeling of the coating from the contact surfaces of the rolling body and the bearing.

SUMMARY OF THE INVENTION

In accordance with the present invention, a swash plate compressor has a housing, a drive shaft, a swash plate, a piston, first and second spaced shoes and a rolling body. The housing has a cylinder bore formed therein. The drive shaft is rotatably supported by the housing. The swash plate is operatively coupled to the drive shaft for rotation with the drive shaft. The piston is accommodated in the cylinder bore for reciprocating movement. The first and second spaced shoes fitted to the piston on a side adjacent to the cylinder bore and on a side away from the cylinder bore, respectively, for coupling the piston to the swash plate. The rolling body is mounted on the swash plate through a bearing and in slide contact with the first shoe. A surface of the rolling body in slide contact with the first shoe or a surface of the first shoe in slide contact with the rolling body has a diamond-like carbon film formed thereon. A surface of the rolling body in rolling contact with the bearing exposes a base material of the rolling body.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
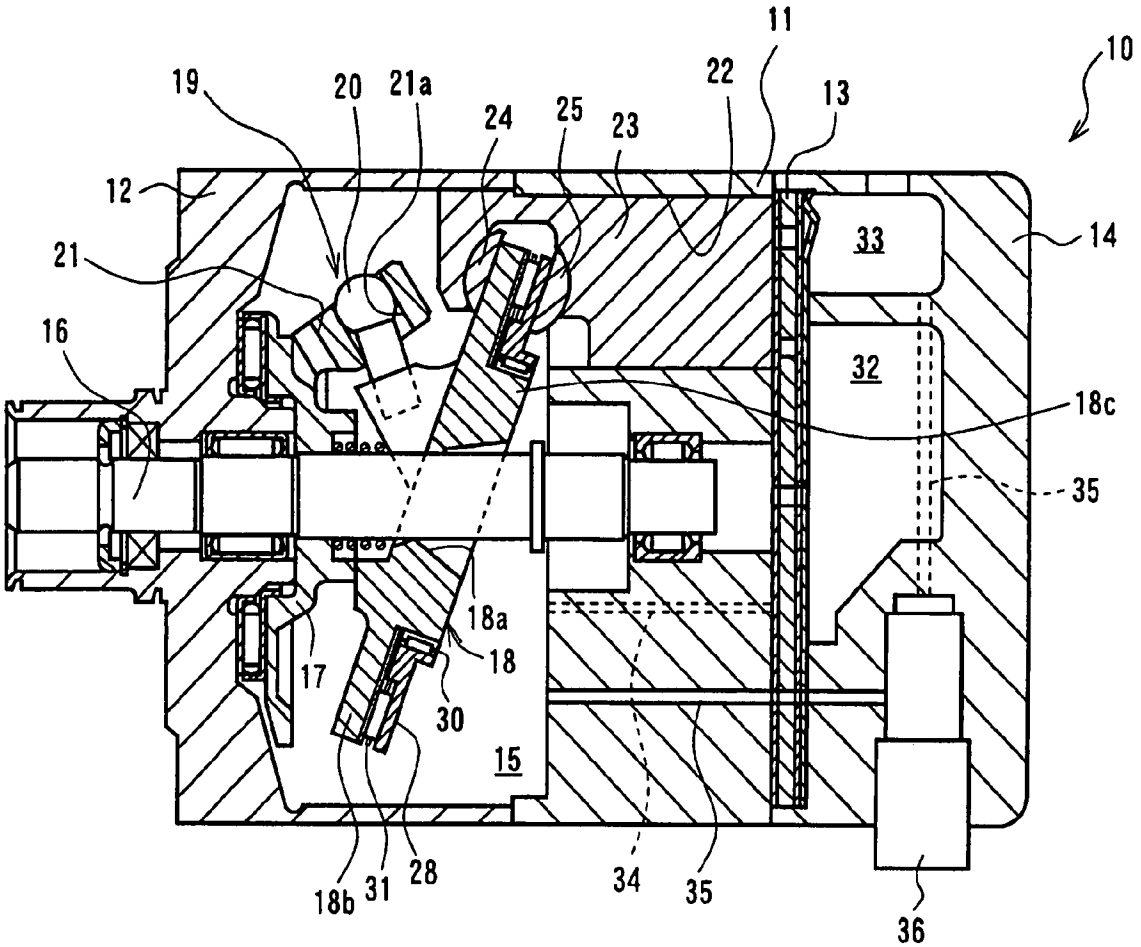
FIG. 1 is a longitudinal sectional view of a swash plate compressor according to a first preferred embodiment of the present invention.
Figure 2:
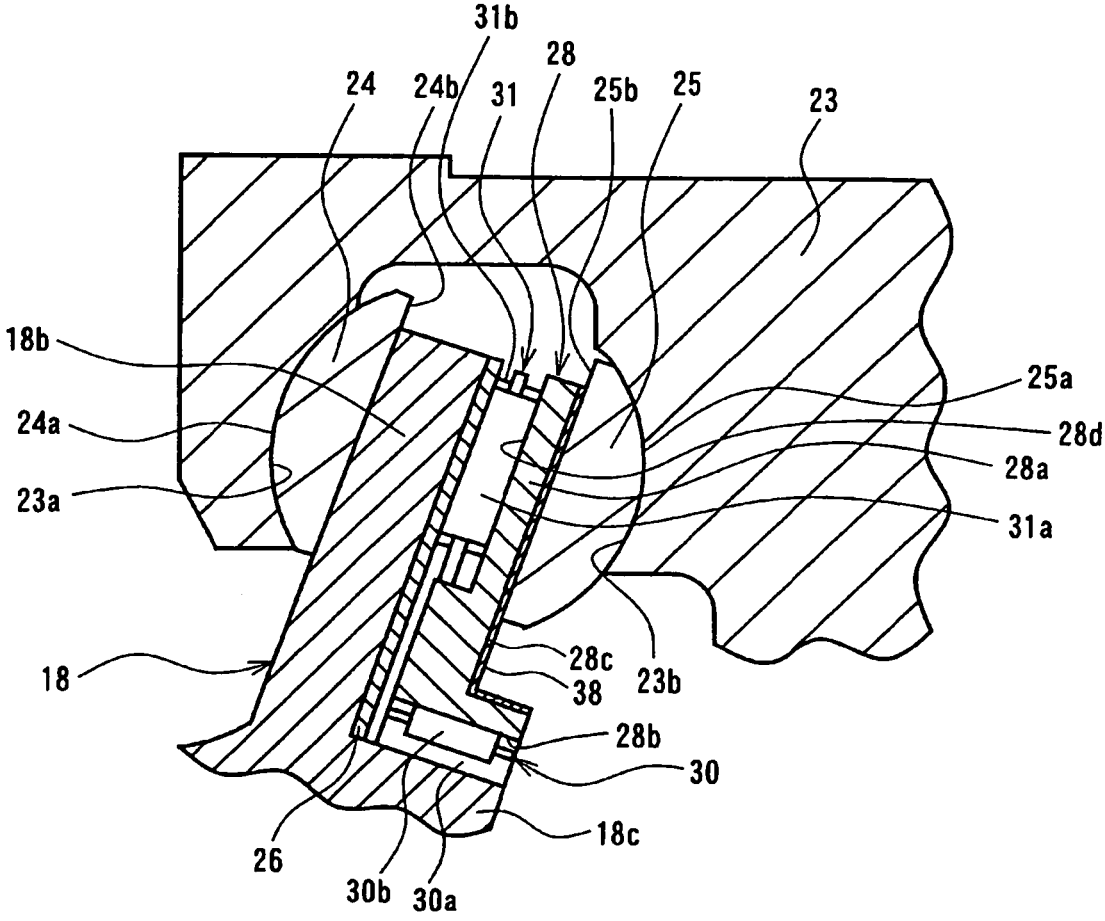
FIG. 2 is a partially enlarged view of FIG. 1.

The following will describe a first preferred embodiment of a swash plate compressor according to the present invention with reference to FIGS. 1 and 2. FIG. 1 shows a longitudinal sectional view of a single-headed piston type variable displacement swash plate compressor 10. The left side and the right side of the compressor 10 shown in FIG. 1 correspond to the front side and the rear side thereof, respectively.

As shown in FIG. 1, the compressor 10 includes a cylinder block 11, a front housing 12 fixedly connected to the front end of the cylinder block 11 and a rear housing 14 fixedly connected to the rear end of the cylinder block 11 through a valve plate assembly 13. The cylinder block 11, the front housing 12 and the rear housing 14 cooperate to form the housing assembly of the compressor 10.

A crank chamber 15 is formed in the housing assembly between the cylinder block 11 and the front housing 12. A drive shaft 16 is rotatably supported at the center of the crank chamber 15 so as to extend therethrough. A lug plate 17 is secured to the drive shaft 16 in the crank chamber 15 so that it is rotatable integrally therewith. The lug plate 17 has a pair of support arms 21, each having a guide hole 21*a* formed therein. A swash plate 18, which is disc-shaped, having a hole at its center, is accommodated in the crank chamber 15. The swash plate 18 has a central thick boss portion 18*c*, a peripheral portion 18*b* having a smaller thickness than the boss portion 18*c* and a central hole 18*a* through which the drive shaft 16 is inserted. The swash plate 18 has a projection on its front face, and a pair of guide pins 20 is assembled to the projection so as to extend toward the support arms 21. The swash plate 18 is made of a ferrous metal. A hinge mechanism 19 is provided between the lug plate 17 and the swash plate 18. The hinge mechanism 19 is formed by spherical bodies at the distal ends of the guide pins 20 which are inserted into the guide holes 21*a* of the support arms 21.

The swash plate 18 is operatively connected to the drive shaft 16 through the hinge mechanism 19 and the lug plate 17, so that it is rotatable integrally with the drive shaft 16 and tiltable with respect to the drive shaft 16 while sliding in the axial direction of the drive shaft 16. A plurality of cylinder bores 22 (only one being shown in FIG. 1) is formed in the cylinder block 11, each accommodating therein a reciprocally movable single-headed piston 23. As shown in FIG. 2, each piston 23 has formed at the neck portion thereof a pair of concave shoe seats 23*a*, 23*b*, and a pair of spaced hemispherical shoes 24, 25 is to the shoe seats 23*a*, 23*b*, respectively. The shoes 24, 25 are made of a ferrous metal.

An annular rolling body 28 is assembled to the swash plate 18 through a thrust bearing 31 and a radial bearing 30, as shown in FIG. 2. The annular rolling body 28 has a support hole 28*b* at its center. The radial roller bearing 30 is interposed between the inner peripheral surface of the support hole 28*b* and the outer peripheral surface of the boss portion 18*c*, so that the rolling body 28 is rotatably supported by the swash plate 18. The radial bearing 30 includes a cage 30*a* and a plurality of rollers 30*b* located on the cage 30*a*. The thrust roller 31 is interposed between the peripheral portion 28*a* of the rolling body 28 and the peripheral portion 18*b* of the swash plate 18. The thrust bearing 31 includes a plurality of rollers 31*a* which are rotatably held by the cage 31*b*. An annular race 26 is interposed between the rollers 31*a* of the thrust bearing 31 and the peripheral portion 18*b* of the swash plate 18. The base of the rolling body 28 is made of a ferrous metal.

The rolling body 28 is mounted to the swash plate 18 through the radial bearing 30 and the thrust bearing 31 so that it is rotatable relatively to the swash plate 18 and tiltable integrally therewith. As the swash plate 18 rotates, the rolling body 28 rolls on the swash plate 18 due to the radial bearing 30 and the thrust bearing 31, thus reducing the frictional resistance between the rolling body 28 and the swash plate 18.

The peripheral portion 18*b* of the swash plate 18 and the peripheral portion 28*a* of the rolling body 28 are located between paired shoes 24, 25, which are spaced at a specified interval, thus the swash plate 18 being coupled to the pistons 23. The shoe 24 on the front side (located away from the cylinder bore 22) slidably contacts at its spherical surface 24*a* with the shoe seat 23*a* and at its flat surface 24*b* on the opposite side to the spherical surface 24*a* with the front face of the peripheral portion 18*b* of the swash plate 18. On the other hand, the shoe 25 on the rear side (located adjacent to the cylinder bore 22) slidably contacts at its spherical surface 25*a* with the shoe seat 23*b* and at its flat surface 25*b* on the opposite side to the spherical surface 25*a* with the rear face of the peripheral portion 28*a* of the rolling body 28. Each piston 23 is thus coupled to the peripheral portions 18*b*, 28*a* of the swash plate 18 and the rolling body 28 through the shoes 24, 25. As the swash plate 18 is rotated by the drive shaft 16, the pistons 23 are moved reciprocally in the cylinder bores 22.

As shown in FIG. 1, a suction chamber 32 and a discharge chamber 33 are formed in the housing assembly of the compressor 10 between the valve plate assembly 13 and the rear housing 14. The suction chamber 32 and the discharge chamber 33 are selectively communicable with each cylinder bore 22 through the flapper valves of the valve plate assembly 13. In operation of the compressor 10 when the piston 23 is moved reciprocally in the cylinder bore 22, refrigerant gas introduced from external refrigerant circuit (not shown) into the suction chamber 32 is drawn into the cylinder bore 22 through the valve, then compressed and discharged into the discharge chamber 33.

The housing assembly of the compressor 10 has a bleed passage 34 for communication between the crank chamber 15 and the suction chamber 32, a supply passage 35 for communication between the discharge chamber 33 and the crank chamber 15 and an electromagnetic control valve 36 disposed in the supply passage 35. The pressure in the crank chamber 15 is controlled by adjusting the opening of the control valve 36.

The swash plate 18 is operable to move toward its vertical position (that is, the inclination angle of the swash plate 18 decreases) as pressure in the crank chamber 15 is raised. On the other hand, the swash plate 18 tilts moving away from the vertical position (that is, the inclination angle of the swash plate 18 increases) as pressure in the crank chamber 15 is lowered. The stroke of the pistons 23 in the cylinder bore 22 changes with the inclination angle of the swash plate 18. When pressure in the crank chamber 15 is high and the inclination angle of the swash plate 18 is small, the stroke of the pistons 23 is short. On the other hand, when pressure in the crank chamber 15 is low and the inclination angle of the swash plate 18 is large, the stroke of the pistons 23 is long. The displacement of the compressor 10 is reduced with a decrease of the stroke length of the piston 23, and vice versa.

As shown in FIG. 2, the rear face 28*c* of the rolling body 28 that contacts with the shoe 25 adjacent to the cylinder bore 22 has a diamond-like carbon film (or DLC film) 38 formed thereon. The DLC film 38 is formed by a known process, such as chemical vapor deposition (CVD) and physical vapor deposition (PVD). The DLC film 38 is generally called in various ways such as synthetic diamond thin film, diamond-like carbon film, i-carbon film, or the like. In this embodiment, it will be called diamond-like carbon film. The rolling body 28 is in slide contact with the flat surface 25*b* of the shoe 25 at the surface of the DLC film 38.

Ferrous metal heat-treated by tempering at a high temperature is used as a base material for the rolling body 28. This heat-treatment helps to prevent a decrease in surface hardness of the base material by any further treatment for forming the DLC film 38 on the rolling body 28 under a high temperature and maintain the desired hardness. The DLC film 38 has physical properties similar to those of diamond such as hardness, thus providing a high degree of hardness and a low friction coefficient.

The rolling body 28 hardly rotates relatively to the shoe 25, but mostly follows the shoe 25. Though it is difficult for an oil film to be formed between the rolling body 28 and the shoe 25, desirable sliding condition is maintained because of the DLC film 38 formed on the contact surface of the rolling body 28, thus preventing troubles associated with abrasion or seizure between the rolling body 28 and the shoe 25.

The inner peripheral surface of the support hole 28*b* of the rolling body 28 which is in rolling contact with the rollers 30*b* of the radial bearing 30 is not coated with DLC film, and the base material is exposed. Therefore, the rollers 30*b* are in rolling contact with the surface of the base material. The front face 28*d* which is in rolling contact with the rollers 31*a* of the thrust bearing 31 of the rolling body 28 is not coated with DLC film, either, and the base material is exposed. Therefore, the rollers 31*a* are in rolling contact with the surface of the base material. However, the surface-hardened ferrous metal is used as base material for the rolling body 28, so that the surface of the base material of the rolling body 28 can resist abrasion or wear which may be otherwise caused by repeated stress acting on the surface due to the rolling of the rollers 30*b*, 31*a*.

The following will describe the operation of the compressor 10 according to the first preferred embodiment.

As the swash plate 18 is rotated by the drive shaft 16 which is coupled to an external drive source, the rolling body 28 rolls on the swash plate 18 through the radial roller bearing 30 and the thrust roller bearing 31 provided between the swash plate 18 and the rolling body 28, and the rolling body 28 mounted to the swash plate 18 hardly rotates, but it swings back and forth with the swash plate 18. Such movement of the swash plate 18 causes each piston 23 to slide reciprocally in the cylinder bore 22 by way of the paired shoes 24, 25 that are in slide contact with the peripheral portions of the swash plate 18 and the rolling body 28, respectively.

When the piston 23 is moved from the top dead center toward the bottom dead center, refrigerant gas in the suction chamber 32 is drawn into the cylinder bore 22 while pushing open a suction valve formed in the valve plate assembly 13. When the piston 23 is moved from the bottom dead center toward the top dead center, refrigerant gas in the cylinder bore 22 is compressed to a specified value. The compressed refrigerant gas is discharged into the discharge chamber 33 while pushing open a discharge valve formed in the valve plate assembly 13 and then delivered to the external refrigerant circuit.

Reaction force which is generated when the piston 23 is forcibly pulled by the swash plate 18 during the suction stroke acts mainly on the front face of the peripheral portion 18*b* of the swash plate 18 through the shoe 24 on the front side (located away from the cylinder bore 22). On the other hand, compression reaction force produced when the piston 23 is moved for compression of refrigerant gas during the discharge stroke acts mainly on the rear face 28*c* of the peripheral portion 28*a* of the rolling body 28 through the shoe 25 on the rear side (located adjacent to the cylinder bore 22). The reaction force during the suction stroke is far less than the compression reaction force during the compression stroke.

The front face of the peripheral portion 18*b* of the swash plate 18 is in direct slide contact with the flat surface 24*b* of the shoe 24 and the speed of relative rotation between the swash plate 18 and the shoe 24 is high. However, since the reaction force developed during the suction stroke of the piston 23 is relatively small, abrasion or seizure is prevented from occurring without improvement of sliding condition. On the other hand, compression reaction force of a large magnitude acts on the rear face 28*c* of the peripheral portion 28*a* of the rolling body 28 and the flat surface 25*b* of the shoe 25. However, since the rolling body 28 hardly rotates relatively to the swash plate 18 and, therefore, the relative rotation between the rolling body 28 and the shoe 25 is extremely small, the effect of rotation on the rolling body 28 and the shoe 25 is small.

It is difficult for an oil film to be formed between the rolling body 28 and the shoe 25 while the compressor is operating at a low speed and, therefore, there is a fear that abrasion or seizure may occur during such low-speed operation of the compressor 10. In this embodiment, the surface of the rolling body 28 in slide contact with the shoe 25 is formed with DLC film 38, so that sliding condition during the low-speed operation is improved, with the result that abrasion and seizure hardly occur between the rolling body 28 and the shoe 25.

In the meantime, the front face 28*d* of the peripheral portion 28*a* of the rolling body 28 is in rolling contact with the rollers 31*a* of the thrust bearing 31. The front face 28*d* of the rolling body 28 has no DLC film and its base material is exposed. The front face 28*d* of the rolling body 28 is subjected to repeated compression reaction force which is due to the rolling of the rollers 31*a* on the front face 28*d*, and the rolling body 28 is firmly pressed against the rollers 31*a*, accordingly. However, the front face 28*d* of the rolling body 28 that is in rolling contact with the rollers 31*a* is made of surface-hardened ferrous metal, so that the face 28*d* can resist the compression reaction force and prevent troubles associated with abrasion or abnormal wear.

The cylindrical inner peripheral surface of the support hole 28*b* of the rolling body 28 is in rolling contact with rollers 30*b* of the radial bearing 30. Like the front face 28*d* of the rolling body 28, the inner peripheral surface of the support hole 28*b* has no DLC film and, therefore, the base material is exposed. The inner peripheral surface of the support hole 28*b* of the rolling body 28 is subjected to repeated stress, and the rolling body 28 is firmly pressed against the rollers 30*b*. However, the inner peripheral surface of the support hole 28*b* of the rolling body 28 that is in rolling contact with the rollers 30*b* is made of surface-hardened ferrous metal, so that it resists abrasion and degradation.

In this embodiment, the race 26 is interposed between the rollers 31*a* and the peripheral portion 18*b* of the swash plate 18, so that the compression reaction force applied to the rollers 31*a* is transmitted to the swash plate 18 by way of the race 26 and, therefore, partial wear of the swash plate 18 due to direct contact with the rollers 31*a* is prevented. The race 26 rotates relatively to the rolling body 28, so that the part of the race 26 to which compression reaction force of a large magnitude is applied is changed sequentially and, therefore, the race 26 is prevented from being locally worn.

According to the first preferred embodiment of the compressor 10, the following advantageous effects are obtained.

(1) The rolling body 28 is mounted to the swash plate 18 through the radial bearing 30 and the thrust bearing 31, so that the sliding resistance between the swash plate 18 and the rolling body 28 during high-speed rotation of the swash plate 18 is caused only by rolling friction and the rolling body 28 hardly rotates. This makes it difficult for an oil film to be formed between the rolling body 28 and the shoe 25. However, the provision of DLC film 38 on the surface of the rolling body 28 in slide contact with the shoe 25 improves the sliding condition, thus preventing the abrasion and seizure between the rolling body 28 and the shoe 25.

(2) The contact surfaces between the front face 28*d* of the peripheral portion 28*a* of the rolling body 28 and the rollers 31*a* of the thrust bearing 31 have no DLC film and the base materials are exposed on the surfaces. The front face 28*d* of the rolling body 28 is constantly subjected to compression reaction force which is due to the rolling of the rollers 31*a* and the rolling body 28 is pressed strongly against the rollers 31*a*. However, the front face 28*d* of the rolling body 28 that is in rolling contact with the rollers 31*a* is made of a ferrous metal with surface hardening, so that the front face 28*d* resists abrasion or wear which may be otherwise caused by compression reaction force of a large magnitude. In addition, unlike the surface of the rolling body 28 that is in slide contact with the shoe 25, the front face 28*d* of the rolling body 28 has no DLC film, so that there is no possibility of peeling off of the film due to the repeated collision between the front face 28*d* and the rollers 31*a*.

(3) The contact surfaces between the cylindrical inner peripheral surface of the support hole 28*b* of the rolling body 28 and the rollers 30*b* of the radial bearing 30 have no DLC film and the base materials are exposed on the surfaces. The inner peripheral surface of the support hole 28*b* of the rolling body 28 is subjected to repeated stress, and the rolling body 28 is pressed strongly against the rollers 30*b*. However, the inner peripheral surface of the support hole 28*b* of the rolling body 28 that is in rolling contact with the rollers 30*b* is made of a ferrous metal with surface hardening, so that it resists abrasion and degradation. In addition, the inner peripheral surface of the support hole 28*b* of the rolling body 28 has no DLC film, which is different from the contact surface of the rolling body 28 with the shoe 25, so that there is no possibility to peel off due to the repeated collision between the inner peripheral surface and the rollers 30*b*.

(4) In the above-described embodiment, the DLC film 38 may be formed only on the rear face 28*c* of the rolling body 28 which contacts with the shoe 25 and the film formation is thus limited to a small area, with the result that the cost for manufacturing the compressor is reduced.

Figure 3:
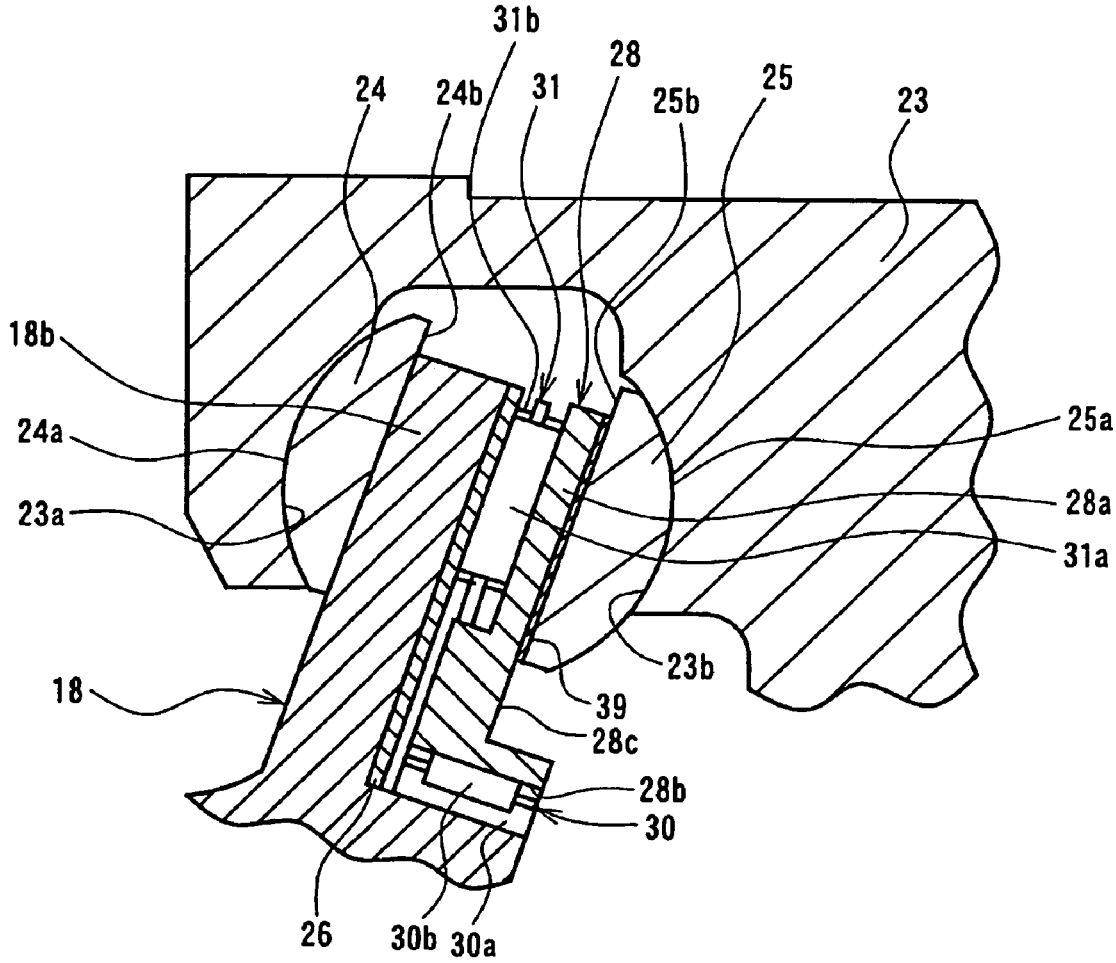
FIG. 3 is a partially enlarged sectional view of a swash plate compressor according to a second preferred embodiment of the present invention.

The following will describe a second preferred embodiment of a swash plate compressor according to the present invention with reference to FIG. 3.

This embodiment differs from the first preferred embodiment in that the position of the DLC film is changed. For the sake of convenience, the same reference numerals denote the components which are substantially identical to those of the first preferred embodiment, and the description for the identical components will be omitted. Only the modified portions of the embodiment will be described.

Referring to FIG. 3, the rear face 28*c* of the rolling body 28 that contacts with the shoe 25 adjacent to the cylinder bore 22 has a DLC film 39 formed thereon only in the area that is in direct contact with the flat surface 25*b* of the shoe 25.

According to the second preferred embodiment, in comparison to the DLC film 38 formed on the entire surface of the rear face 28*c* of the rolling body 28, the area of the film is small, thus reducing the cost for manufacturing.

Figure 4:
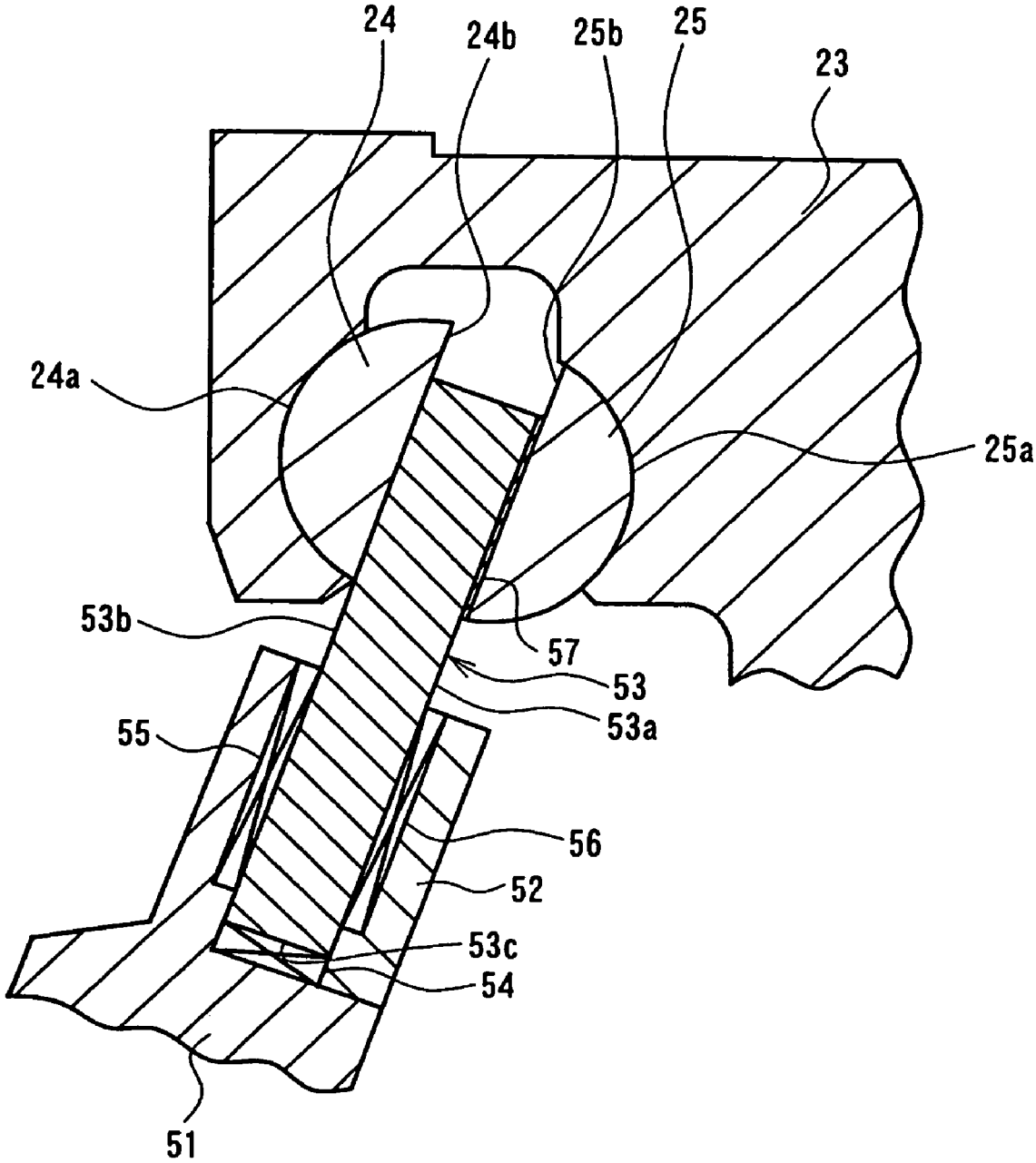
FIG. 4 is a partially enlarged sectional view of a swash plate compressor according to a third preferred embodiment of the present invention.

The following will describe a third preferred embodiment of a swash plate compressor according to the present invention with reference to FIG. 4. This embodiment differs from the first preferred embodiment in the manner of mounting of the swash plate and the rolling body and, therefore, the description for the identical components will be omitted. Only the modified portions will be described.

As shown in FIG. 4, a retainer 52 is secured to the swash plate 51 by a screw (not shown), or the like, thereby to form an annular groove, in which a radial bearing 54 for rotatably supporting the rolling body 53 and a pair of thrust bearings 55, 56 are provided. These bearings 53, 55, 56 may be roller bearings. Then, the rolling body 53 is held between the pair of shoes 24, 25 to couple the rolling body 53 to the pistons 23 through the pair of shoes 24, 25.

The rear face 53*a* of the rolling body 53 that contacts with the shoe 25 adjacent to the cylinder bore 22 has a DLC film 57 formed on the area that is in slide contact with the flat surface 25*b* of the shoe 25. The surfaces of the rolling body 53 in contact with the shoe 24, the radial bearing 54 and thrust bearings 55, 56 have no DLC film, but the base material, or ferrous metal with surface hardening, is exposed.

Since the rolling body 53 is freely rotatably supported on the swash plate 51 through the radial bearing 54 and the thrust bearings 55, 56, the rolling body 53 hardly rotates during rotation of the swash plate 51 but merely swings back and forth relative to the drive shaft 16. Thus, the relative rotation between the rolling body 53 and the shoes 24, 25 is extremely small, and the effect of rotation is small.

According to the third preferred embodiment, the same advantageous effects are obtained as the first preferred embodiment.

Figure 5:
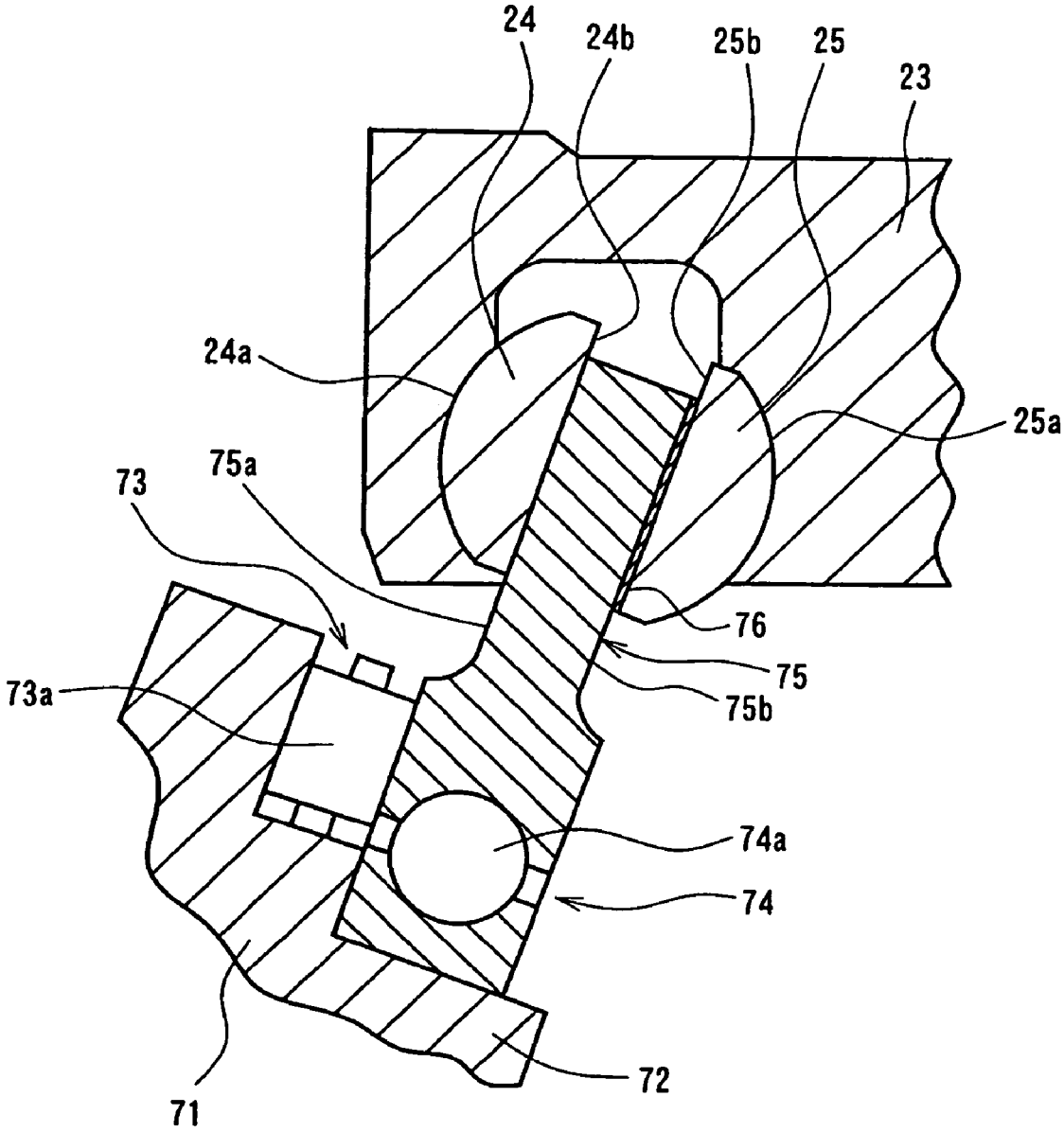
FIG. 5 is a partially enlarged sectional view of a swash plate compressor according to a fourth preferred embodiment of the present invention.

The following will describe a fourth preferred embodiment of a swash plate compressor according to the present invention with reference to FIG. 5. This embodiment differs from the first through third preferred embodiments in the the manner of mounting of the swash plate and the rolling body and, therefore, the description for the identical components will be omitted. Only the modified portions will be described.

As shown in FIG. 5, a swash plate 71 has a boss portion 72 at its center of the rear face, around which a rolling body 75 having a radial ball bearing 74 incorporated therein is fitted. The radial ball bearing 74 has a plurality of balls 74*a*. The rolling body 75 is provided on the outer side of the radial ball bearing 74 in the form of a flange. A thrust roller bearing 73 is interposed between the radially inner portion of the front face 75*a* of the rolling body 75 and the swash plate 71 The thrust roller bearing 73 has a plurality of rollers 73*a*. The rollers 73*a* directly contact with the surfaces of the rolling body 75 and the swash plate 71, as shown in FIG. 5.

The rolling body 75 is held between the pair of shoes 24, 25 and coupled to the pistons 23 through the shoe 24, 25. The rear face 75*b* of the rolling body 75 that contacts with the shoe 25 adjacent to the cylinder bore 22 has a DLC film 76 formed on the area that is in slide contact with the flat surface 25*b* of the shoe 25. The surfaces of the rolling body 75 in slide contact with the shoe 24, the radial bearing 74 and the thrust roller bearing 73 have no DLC film, but the base material, or ferrous metal with surface hardening, is exposed.

Since the rolling body 75 is freely rotatably supported on the swash plate 71 through the radial bearing 74 and the thrust bearings 73, the rolling body 75 hardly rotates during rotation of the swash plate 71; but merely swings back and force relative to the drive shaft 16. Thus, the relative rotation between the rolling body 75 and the shoes 24, 25 is extremely small, and the effect of rotation is small.

According to the fourth preferred embodiment, the same advantageous effects are obtained as the first preferred embodiment.

Figure 6:
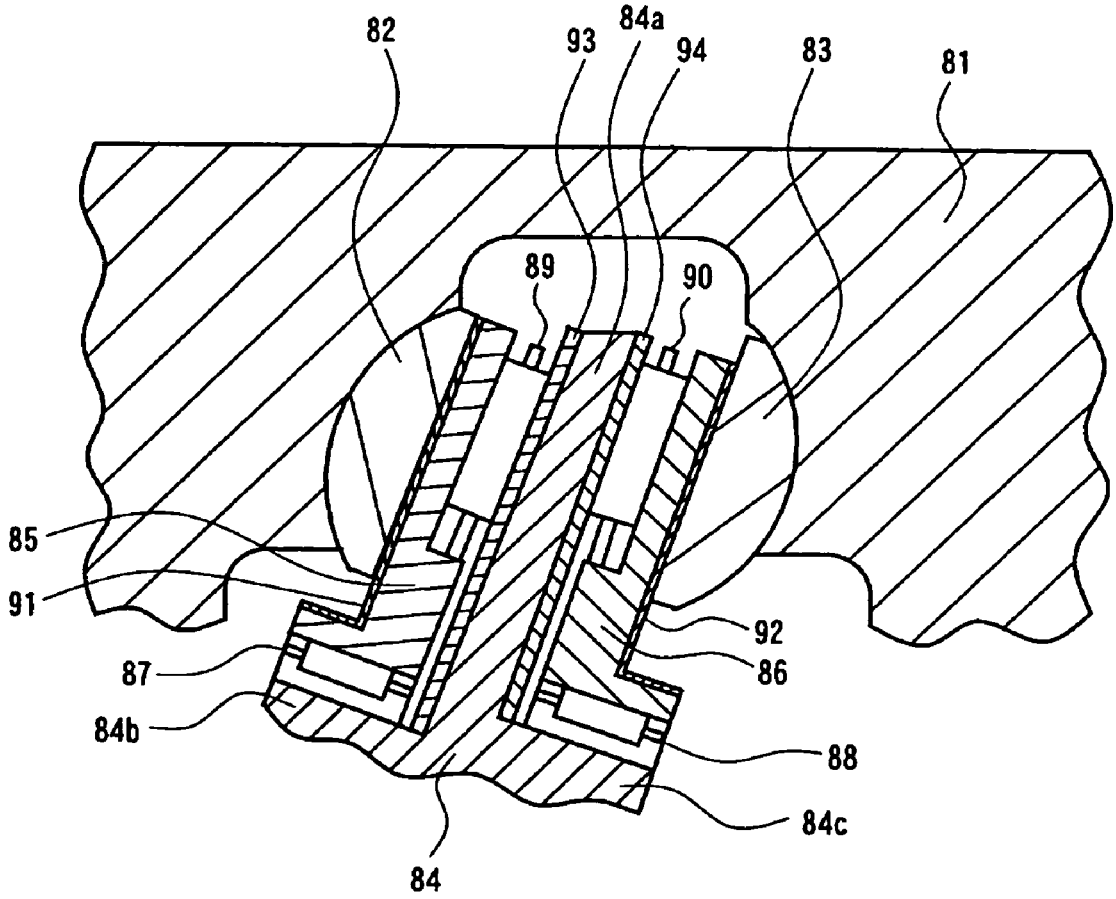
FIG. 6 is a partially enlarged sectional view of a swash plate compressor according to a fifth preferred embodiment of the present invention.

The following will describe a fifth preferred embodiment of a swash plate compressor according to the present invention with reference to FIG. 6. This embodiment shows an example wherein the present invention is applied to a double-headed piston type compressor. For the sake of convenience, the same reference numerals denote the components which are substantially identical to those of the first preferred embodiment, and the description for the identical components will be omitted. Only the modified portions of the embodiment will be described.

As shown in FIG. 6, the swash plate 84 has a first boss portion 84*b* formed at the center on the front side thereof and a second boss portion 84*c* at the center of the rear side thereof. A first rolling body 85 and a second rolling body 86 are fitted around the first boss portion 84*b* and the second boss portion 84*c* through radial bearings 87, 88, respectively. Thrust bearings 89, 90 are interposed between the peripheral portion 84*a* of the swash plate 84 and the first rolling body 85 and between the peripheral portion 84*a* and the second rolling body 86 through races 93, 94, respectively.

The peripheral portion 84*a* of the swash plate 84 is held between the first rolling body 85 and the second rolling body 86 and inserted between a pair of shoes 82, 83, thus the swash plate 84, the first rolling body 85 and the second rolling body 86 being coupled to pistons 81. The front shoe 82 contacts with the first rolling body 85 and the rear shoe 83 contacts with the second rolling body 86. The surfaces of the first rolling body 85 and second rolling body 86 in slide contact with the shoes 82, 83 have DLC films 91, 92 formed thereon, respectively.

Since the first rolling body 85 and the second rolling body 86 are freely rotatably supported on the swash plate 84 through the radial bearing 87, 88 and the thrust bearings 89, 90, the first rolling body 85 and the second rolling body 86 hardly rotate during rotation of the swash plate 84, but merely swings back and forth relative to the drive shaft 16.

According to the fifth preferred embodiment, the same advantageous effects are obtained as the first preferred embodiment.

The present invention is not limited to the embodiments described above but may be modified into alternative embodiments as exemplified below.

Figure 7:
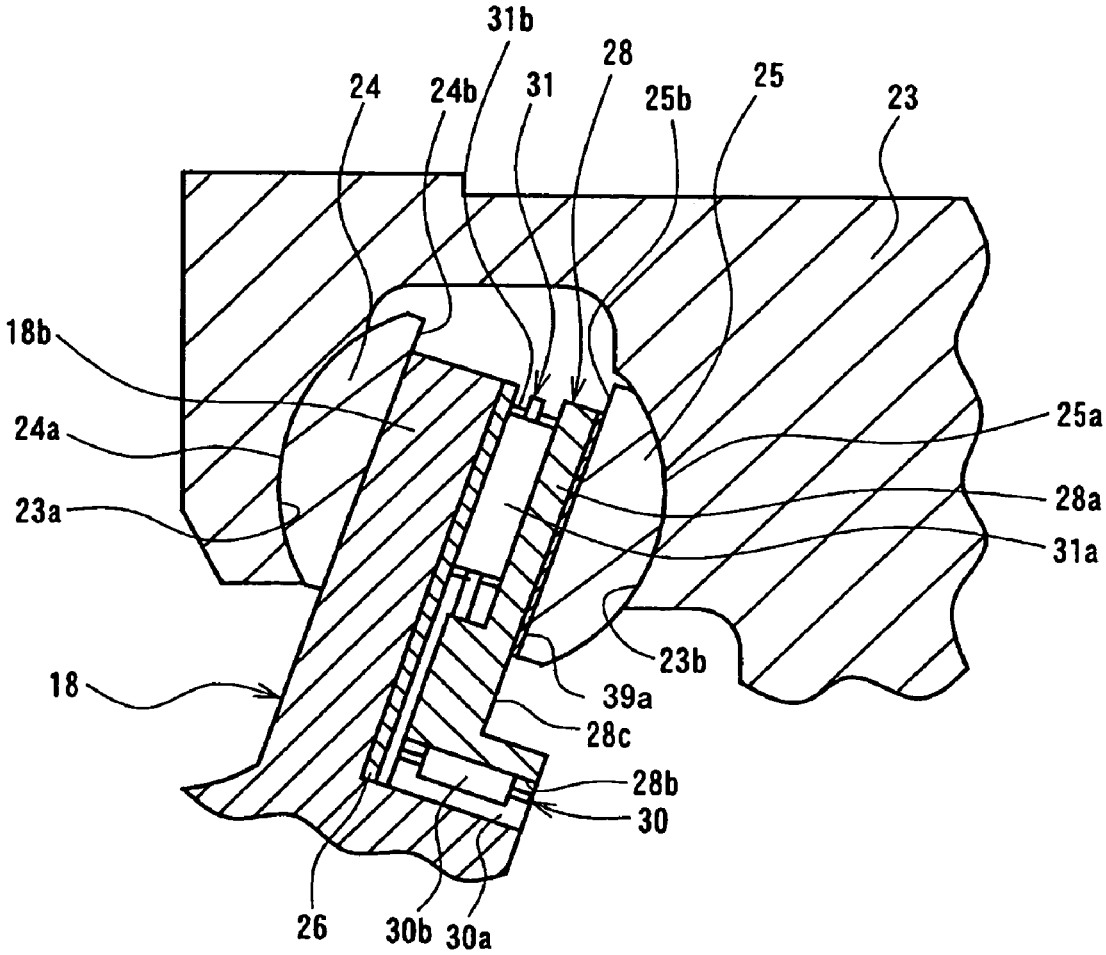
FIG. 7 is a partially enlarged sectional view of a swash plate compressor according to an alternative embodiment of the present invention.
Figure 8:
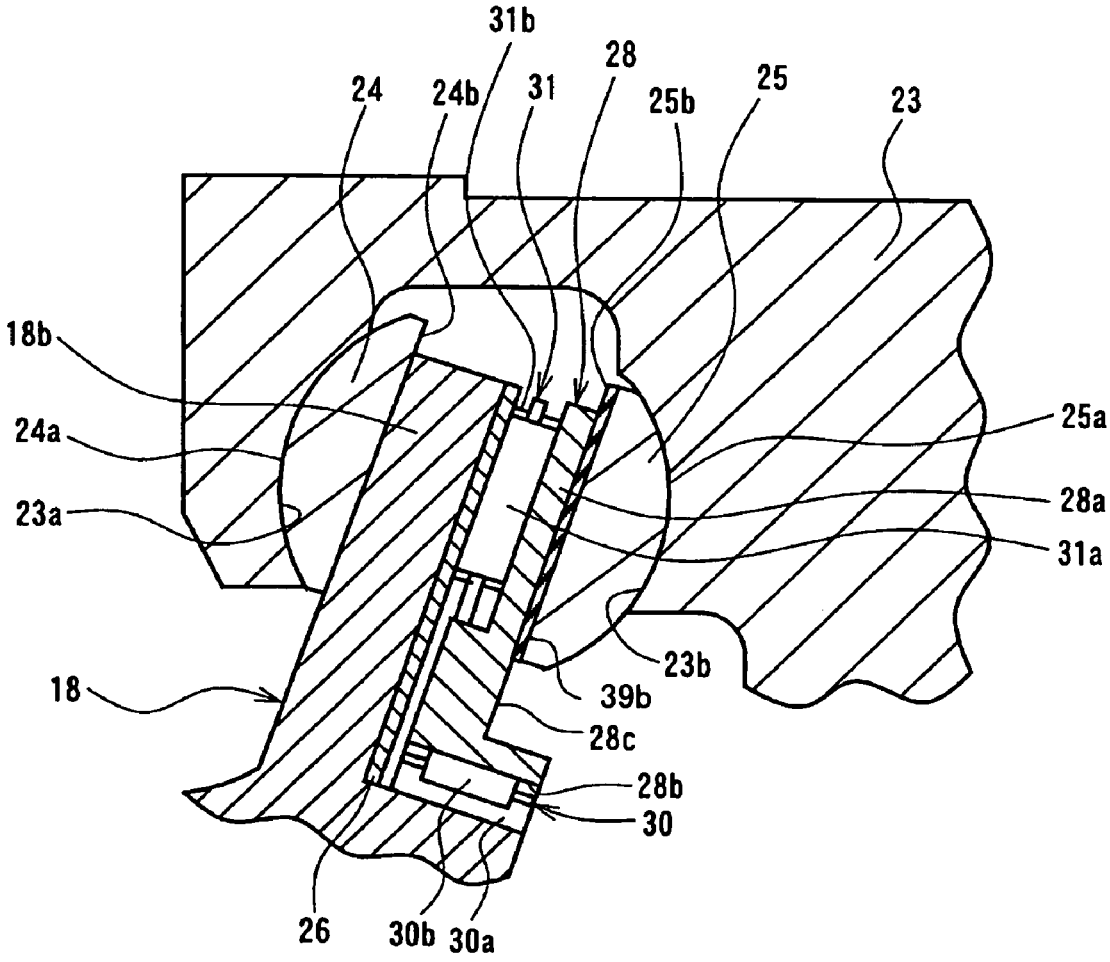
FIG. 8 is a partially enlarged sectional view of a swash plate compressor according to an alternative embodiment of the present invention.

In the above first through fifth preferred embodiments, the DLC film is formed on the surface of the rolling body in slide contact with the shoe adjacent to the cylinder bore. In an alternative embodiment as shown in FIGS. 7, 8, a DLC film 39*a* may be formed only on the surface of the shoe which is in direct slide contact with the rolling body or a DLC film 39*b* may be formed on the entire surface of the shoe which is in slide contact with the rolling body.

In the above first through fifth preferred embodiments, ferrous metal heat-treated by tempering at a high temperature is used as a base material for the rolling body, and high temperature treatment is performed for forming a DLC film on the surface of the rolling body in slide contact with the shoe adjacent to the cylinder bore. In an alternative embodiment, a DLC treatment may be performed according to low-temperature process. In the case of the low-temperature process, the hardness of the base material will not be lowered, so that base materials for selection may be increased.

In the fifth preferred embodiment, the DLC film is formed on the entire surface of the rolling body on the side of the shoe adjacent to the cylinder bore. In an alternative embodiment to the fifth preferred embodiment, the DLC film may be formed only on the area that directly contacts with the flat surface of the shoe as in the case of the second preferred embodiment.

Therefore, the present examples and embodiments are to be considered as illustrative and not restrictive, and the invention is not to be limited to the details given herein but may be modified within the scope of the appended claims.

What is claimed is:

1. A swash plate compressor comprising:

a housing having a cylinder bore formed therein;

a drive shaft rotatably supported by the housing;

a swash plate operatively coupled to the drive shaft for rotation with the drive shaft;

a piston accommodated in the cylinder bore for reciprocating movement;

first and second spaced shoes fitted to the piston on a side adjacent to the cylinder bore and on a side away from the cylinder bore, respectively, for coupling the piston to the swash plate;

a rolling body mounted on the swash plate through a bearing and in slide contact with the first shoe, wherein a surface of the rolling body in slide contact with the first shoe or a surface of the first shoe in slide contact with the rolling body has a diamond-like carbon film formed thereon, and wherein a surface of the rolling body in rolling contact with the bearing exposes a base material of the rolling body.

2. The swash plate compressor according to claim 1, wherein the base material of the rolling body is a surface-hardened ferrous metal.

3. The swash plate compressor according to claim 2, wherein the ferrous metal of the base material is surface-hardened with high-temperature tempering.

4. The swash plate compressor according to claim 2, wherein the ferrous metal of the base material is treated with low-temperature process.

5. The swash plate compressor according to claim 1, wherein a surface of the rolling body in slide contact with the first shoe has a diamond-like carbon film formed thereon.

6. The swash plate compressor according to claim 5, wherein the diamond-like carbon film is formed only on the surface of the rolling body that is in direct slide contact with the first shoe.

7. The swash plate compressor according to claim 6, wherein the diamond-like carbon film is formed on the entire surface of the rolling body that is in slide contact with the first shoe.

8. The swash plate compressor according to claim 1, wherein a surface of the first shoe in slide contact with the rolling body has a diamond-like carbon film formed thereon.

9. The swash plate compressor according to claim 8, wherein the diamond-like carbon film is formed only on the surface of the first shoe that is in direct slide contact with the rolling body.

10. The swash plate compressor according to claim 9, wherein the diamond-like carbon film is formed on the entire surface of the first shoe that is in slide contact with the rolling body.

11. The swash plate compressor according to claim 1, wherein the swash plate is disc-shaped, having a hole at its center and a boss portion formed on its face adjacent to the cylinder bore, wherein the rolling body is annular in shape and assembled to the boss portion of the swash plate through a radial bearing, wherein the rolling body is in slide contact with the first shoe, and wherein the swash plate is in slide contact with the second shoe.

12. The swash plate compressor according to claim 1, wherein the swash plate is disc-shaped, having a hole at its center and first and second boss portions formed, respectively, on its faces adjacent to the cylinder bore and away from the cylinder bore, respectively, wherein the rolling body is annular in shape and assembled to the first and second boss portions of the swash plate through radial bearings, respectively, wherein the rolling bodies are in slide contact with the first shoe and the second shoe, respectively.

13. The swash plate compressor according to claim 1, wherein the swash plate is disc-shaped, having a hole at its center and an annular groove formed on an outer periphery of the swash plate, wherein the rolling body is annular in shape and assembled to the annular groove of the swash plate through a radial bearing, wherein the rolling body is in slide contact with the first shoe and the second shoe, respectively.

14. The swash plate compressor according to claim 1, wherein the swash plate is disc-shaped, having a hole at its center and a boss portion formed on its face adjacent to the cylinder bore, wherein the rolling body is annular in shape and assembled to the boss portion of the swash plate through a radial bearing, wherein the rolling body is in slide contact with the first shoe and the second shoe, respectively.

15. The swash plate compressor according to claim 1, wherein the swash plate compressor is of a variable displacement type.

16. The swash plate compressor according to claim 1, wherein the swash plate compressor is of a single-headed piston type.

17. The swash plate compressor according to claim 1, wherein the swash plate compressor is of a double-headed piston type.

* * * * *